US006035782A

United States Patent [19]

Harrod et al.

[11] Patent Number: 6,035,782

[45] Date of Patent: Mar. 14, 2000

[54] SELECTIVE FLEXOGRAPHIC PRINTING WITH MOVABLE ANILOX ROLL

[75] Inventors: Jimmie A. Harrod, Grand Island; Henk Haan, Niagara Falls, both of N.Y.

[73] Assignee: Moore U.S.A. Inc., Grand Island, N.Y.

[21] Appl. No.: 09/272,619

[22] Filed: Mar. 19, 1999

Related U.S. Application Data

[63] Continuation of application No. 09/070,774, May 1, 1999.

[51] Int. Cl.[7] ..... B41C 33/00

[52] U.S. Cl. ..... 101/483; 101/484; 101/485; 101/350.1

[58] Field of Search ..... 101/483, 350.1, 101/350.2, 350.3, 350.4, 351.2, 351.3, 245, 247, 218, 484, 485, 486, 351.1

[56] References Cited

U.S. PATENT DOCUMENTS

| | | | |
|---|---|---|---|
| 2,737,109 | 3/1956 | Hertsch | 101/245 |
| 3,143,693 | 8/1964 | Schrempp | 101/351.3 |
| 3,163,110 | 12/1964 | Thompson | 101/351.3 X |
| 3,760,723 | 9/1973 | Taig | 101/350 |
| 3,762,323 | 10/1973 | Hartka et al. | 101/350 |
| 3,859,915 | 1/1975 | Hunter | 101/103 |
| 3,903,793 | 9/1975 | Schubert | 101/351.2 |
| 4,309,945 | 1/1982 | Marion | 101/247 |
| 4,964,337 | 10/1990 | Bognar et al. | 101/350 |
| 4,987,831 | 1/1991 | Weder | 101/350 |
| 5,031,532 | 7/1991 | Walther | 101/351 |
| 5,088,407 | 2/1992 | Helm et al. | 101/350 |
| 5,191,836 | 3/1993 | Weis | 101/247 X |
| 5,228,390 | 7/1993 | Jahn | 101/352 |
| 5,791,246 | 8/1998 | Kelm | 101/218 |
| 5,806,427 | 9/1998 | Niemiro et al. | 101/247 |

*Primary Examiner*—Ren Yan
*Assistant Examiner*—Minh H. Chau
*Attorney, Agent, or Firm*—Nixon & Vanderhye P.C.

[57] ABSTRACT

A printing apparatus includes an inker roll, a plate cylinder and an impression cylinder mounted for rotation about parallel axes. The inker roll is selectively displaced into engagement and disengagement with the plate cylinder to transfer ink to the plate cylinder and to a substrate about the impression cylinder. The inker roll is moved to transfer ink only during printing cycles and is out of engagement with the plate cylinder during non-printing cycles. A doctor blade engages the inker roll along a diameter thereof passing through the pivotal axis of the inker roll and its axis of rotation and on the side of the axis of rotation remote from its pivotal axis.

9 Claims, 2 Drawing Sheets

SELECTIVE FLEXOGRAPHIC PRINTING WITH MOVABLE ANILOX ROLL

This is a continuation of application Ser. No. 09/070,774, filed May 1, 1999, now pending.

TECHNICAL FIELD

The present invention relates to flexographic printing and particularly relates to flexographic printing wherein the anilox or inker roll is movable toward and away from the plate cylinder on a selective basis to apply ink to the plate cylinder only during printing.

BACKGROUND

In prior application Ser. No. 08/359,697, filed Dec. 20, 1994, there is disclosed a method and apparatus including flexographic printing units which enable substantially simultaneous printing of a web of paper to produce discrete documents with selective non-variable and variable information in a quick, accurate and efficient manner. For example, the prior application discloses a method of producing discrete documents with varying numbers of pages which consist of both non-variable and variable printed information during a single pass in a continuous printing operation. An example of the type of product is a telephone bill which contains multiple pages of both variable and non-variable information. The advantages of such a system are set forth in the prior application, the disclosure of which is incorporated herein by reference.

In a typical flexographic printing unit, there is provided an anilox or inker roll in contact with a supply of ink. A plate or image cylinder is in contact with the inker roll whereby ink from the supply source is transferred to the inker roll and then onto a plate cylinder. The plate cylinder, in turn, is in periodic contact with a substrate, i.e., a web of paper, formed about an impression cylinder. With the rotation of the various cylinders and inker roll, the plate cylinder is inked and its image is transferred onto the substrate. As set forth in that prior application, the flexographic print units are independently controlled by a computer to operatively engage and disengage the paper web and thereby print non-variable information using at least one of the flexographic units on each discrete document portion of the paper web.

DISCLOSURE OF THE INVENTION

In accordance with the present invention, the inker roll is only in contact with the plate cylinder for one revolution during each print revolution. That is, the inker roll is in contact with the plate cylinder only during printing revolutions of the plate and impression cylinders and is inhibited from contact with the plate cylinder during non-printing revolutions, thereby preventing any re-inking of the plate cylinder. Re-inking of the plate cylinder during non-printing revolutions of the plate and impression cylinders causes variations in print density on the substrate. While originally thought to be acceptable, such variations are no longer acceptable, particularly with customers used to conventional lithographic quality and processes. Consequently, re-inking of the plate cylinder during non-printing revolutions is prevented and the inker roll is in contact with the plate cylinder only during printing revolutions.

To accomplish the foregoing, an inker roll is mounted for pivotal movement about a pivotal axis enabling movement of the inker roll toward and away from the plate cylinder for engagement with and disengagement from the plate cylinder. The magnitude of the displacement is quite small, i.e., on the order of about 0.010 inch, as measured between the nearest opposite surfaces of the inker roll and plate cylinder. A portion of the inker roll is normally disposed in a bath of ink. A doctor blade lies along a diametrical line passing through the pivot for the inker roll and its axis of rotation. The doctor blade lies on the opposite side of the axis of rotation of the inker roll from the inker roll pivot. The contact line between the edge of the doctor blade and the surface of the inker roll lies along a tangent of the inker roll such that the relative location of contact between the doctor blade and inker roll remains substantially constant during movement of the inker roll toward and away from the plate cylinder. This is necessary so that the doctor blade maintains constant pressure on the inker roll at all times.

In a preferred embodiment according to the present invention, there is provided in a printing apparatus for selectively printing non-variable information on discrete document portions of a web during a discrete continuous printing run for the web including an inker roll, a plate cylinder and an impression cylinder mounted for rotation about parallel axes, a method of operating the printing apparatus, comprising the steps of selectively and periodically displacing the inker roll into contact with the plate cylinder during the continuous discrete printing run for the web in response to computer-generated print commands to transfer ink from the inker roll to the plate cylinder upon initiation of printing revolutions of the inker roll, plate cylinder and impression cylinder to print the non-variable information on selected discrete document portions of the web and selectively and periodically displacing the inker roll away from and out of contact with the plate cylinder during the continuous discrete printing run for the web upon initiation of non-printing revolutions of the inker roll, plate cylinder and the impression cylinder to prevent transfer of ink from the inker roll to the plate cylinder and onto other discrete document portions of the single web.

In a further preferred embodiment according to the present invention, there is provided in a printing apparatus for selective printing non-variable information on discrete document portions of a single web during a discrete continuous printing run for the web including an inker roll, a plate cylinder and an impression cylinder carrying the web, the inker roll and cylinders being mounted for rotation about parallel axes, a method of operating the printing apparatus, comprising the steps of selectively and periodically displacing the impression cylinder and web carried thereby into contact with the plate cylinder during the continuous discrete printing run for the web in response to computer-generated print commands to transfer ink from the plate cylinder to the web during printing revolutions of the inker roll, plate cylinder and impression cylinder to print the non-variable information on selected discrete document portions of the web and selectively and periodically displacing the impression cylinder and the web carried by the impression cylinder during the discrete printing run away from and out of contact with the plate cylinder during non-printing revolutions of the inker roll, plate cylinder and the impression cylinder to prevent transfer of ink from the plate cylinder to the web and onto other discrete portions of the single web.

According, it is a primary object of the present invention to provide a novel and improved method of operating a selective flexographic printing process having an inker roll movable toward and away from a plate cylinder to avoid re-inking during non-printing cycles.

BEST MODE FOR CARRYING OUT THE INVENTION

Figure 1:
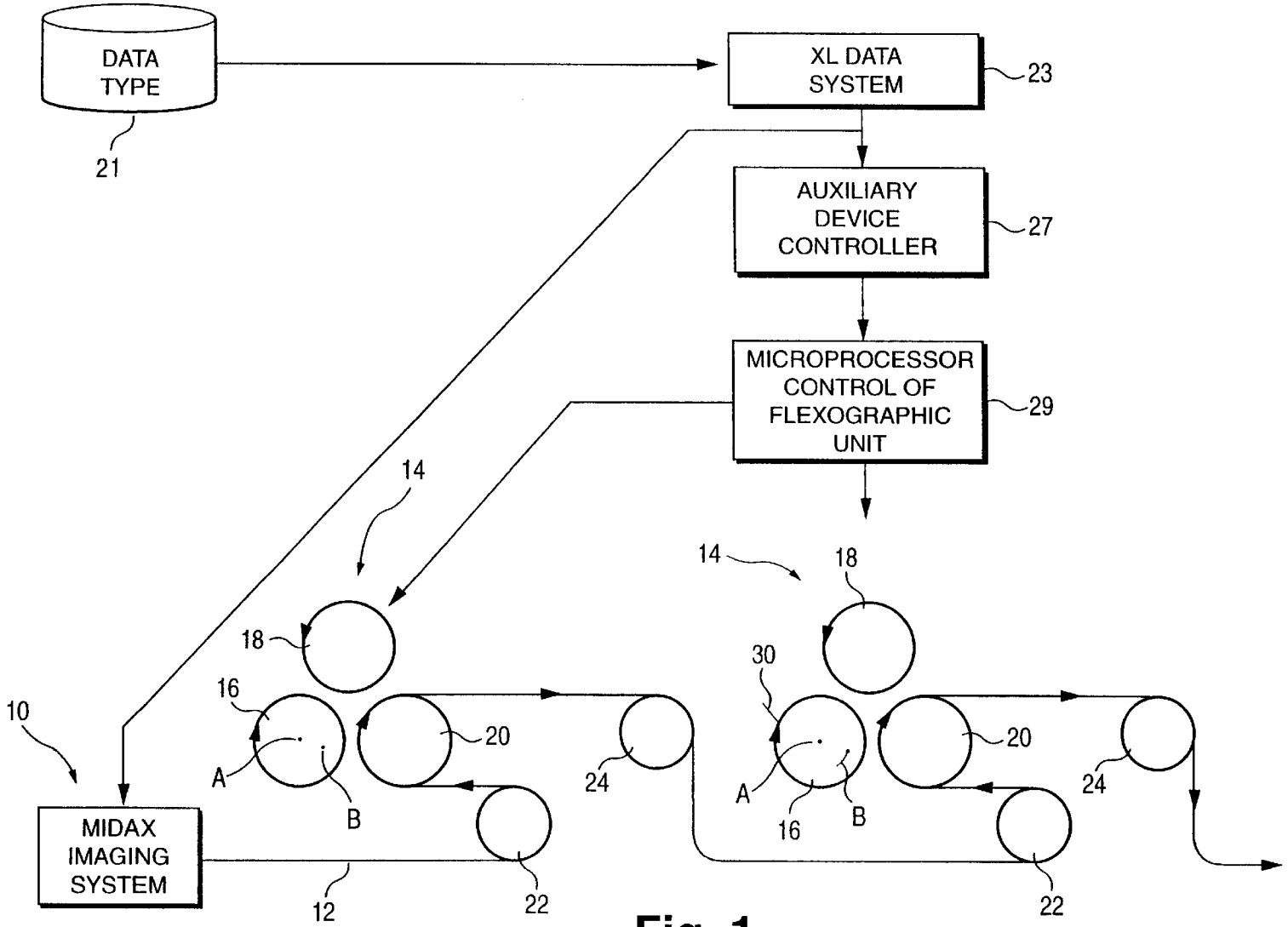
FIG. 1 is a schematic representation of various components of an exemplary apparatus for practicing the method of the present invention.

Referring now to the drawing figures, particularly to FIG. 1, there is illustrated a printing apparatus according to the method of the present invention including a first print unit, preferably an ion deposition print unit 10 which may be a MIDAX® imaging system, for example, a MIDAX® 300 print engine commercially available from Moore Business Forms, Inc. of Lake Forest, Ill. The print engine 10 operates by producing a latent electrostatic image on an image cylinder using an ion print cartridge. The image cylinder transfers the image onto a moving paper web 12. A typical ion deposition print engine is illustrated in U.S. Pat. No. 5,132,713 and various other patents referenced in the above-identified patent application relate to various portions of the ion deposition printer 10.

Following the imaging system 10, there are provided a plurality of flexographic print units, generally designated 14. Each unit includes an anilox or inker roll 16, a plate or image cylinder 18 and an impression cylinder 20. The web 12 passes over the impression cylinder 20 and is printed by contact with the ink on the plate cylinder 18. The arrows in the schematic illustrations of the inker roll and cylinders illustrate the directions of rotation of those elements. Various idler rollers 22 and 24 are provided for engaging the web on the input and output sides, respectively, of the flexographic print units 14. While only two flexographic print units are illustrated, an additional number of units may be provided. It will therefore be appreciated that the system 10 may print variable information on the various portions of the web as necessary or desirable and is under computer control, while the flexographic printing units 14 may print non-variable information along selected portions of the web 12 as it passes through the flexographic printing units 14. As the web 12 is progressively printed with variable and non-variable information, it will be appreciated that at the end of the printing process, the web 12 may be passed through a paper handling unit, for example, for cutting, slitting, punching or perforating or through other conventional components whereby the web can be separated into individual discrete multi-page documents, for example, phone bills each having its own header (non-variable information), customer information and usage (variable information). The various documents may then be collated to form an integrated document and placed in a conventional envelope for mailing.

FIG. 1 also shows various control components associated with the apparatus, for practicing the method according to the invention, and which control system is described and illustrated in prior application Ser. No. 08/359,697, filed Dec. 20, 1994, the disclosure of which is incorporated herein by reference. A data source 21 typically is in the form of a data tape, and has selective fields thereon which provide the variable information required for the imaging process. An indicator (selectable criteria) is encoded on the data tape 40 for each header page (bill) to be printed. The system also includes a first computer, shown schematically at 23. The first computer 23 includes a data processing and control system which is capable of driving high speed print devices simultaneously. The preferred first computer 23 may comprise an XL DATA SYSTEM™ available from Moore Business Forms, Inc. of Lake Forest, Ill., and including a high speed data transfer module described and illustrated in the above-identified patent application.

The first computer 23 is typically connected to the ion deposition print unit 10. The computer 23 also indirectly controls the flexo units 14. The computer 23 controls form lag (the time and distance between each control device that performs a function on a common form in the production line when handling the web 12). The signal for form lag is transmitted—as indicated schematically at 25 to an auxiliary device controller (ADC) 27. The ADC 27 provides an initiation signal to microprocessor controller (second computer) 29, for each of the flexo units 14. Each of the flexo units 14 is controlled independently. Once initiated, the microprocessor 29 is used to accurately control the length of the flexographic plate engagement, on/off signal compensation, and web speed-following. Typically a separate pattern for each unit 14 is programmed into the microprocessor controller 29. The patterns are selected by the initiation signal input from the ADC 27. Each flexographic unit 14 then functions independently. This can be changed by inputting information into the computer/microprocessor 29, utilizing any suitable inputting means.

Figure 2:
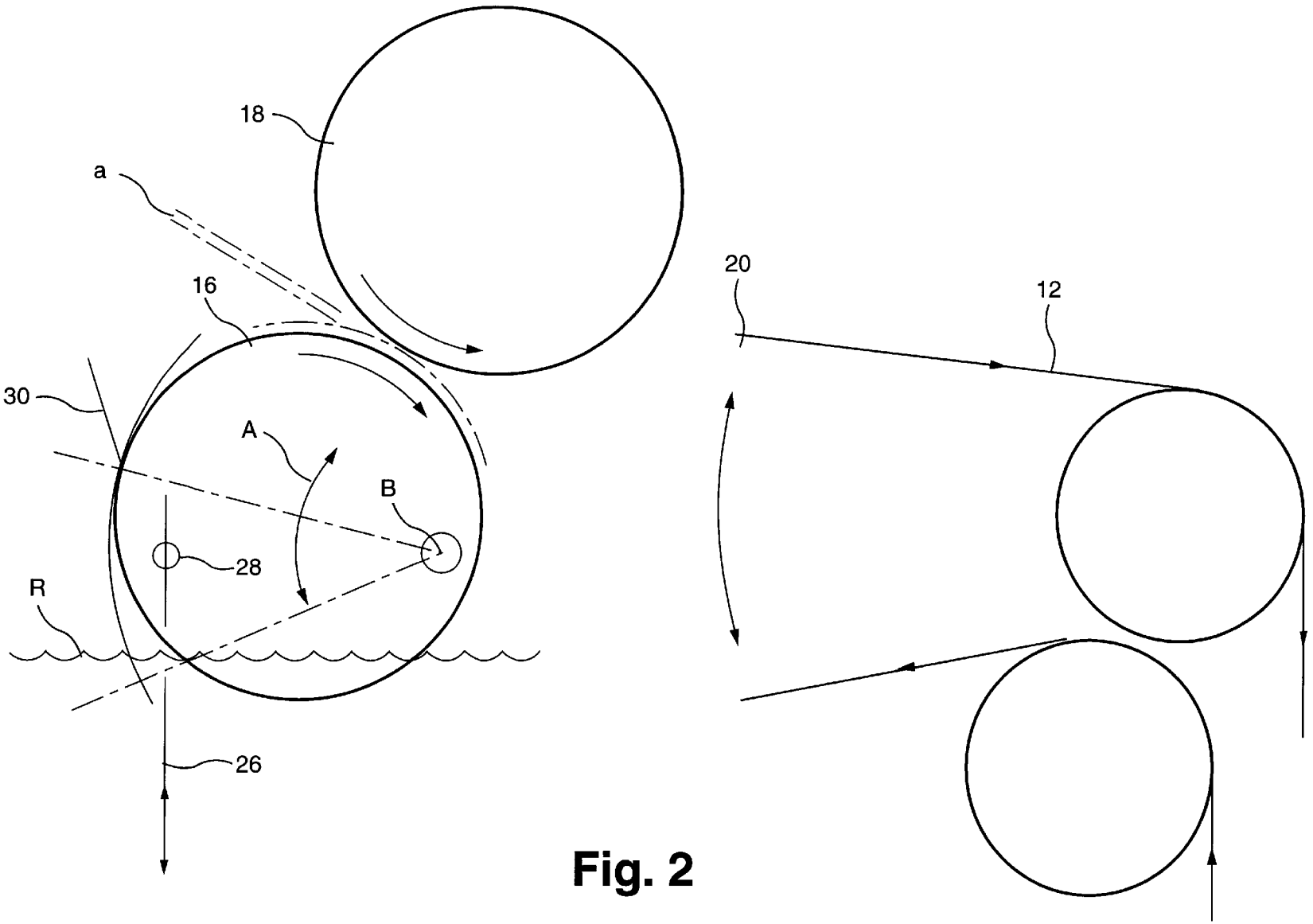
FIG. 2 is a schematic illustration of the inker roll, plate cylinder and impression cylinder of a flexographic printing unit according to the present invention.
Figure 2:
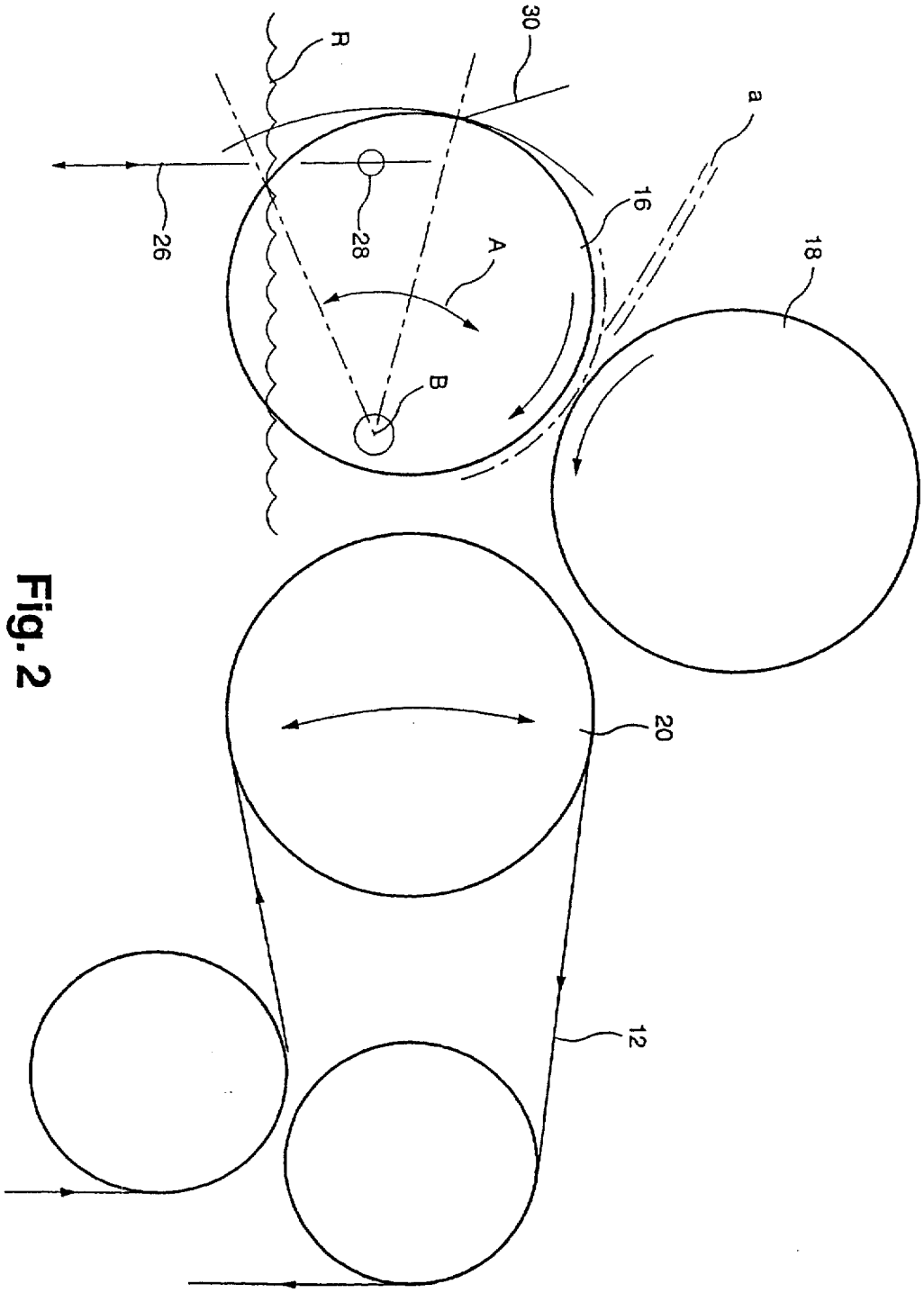

Referring now to FIG. 2, it will be seen that the impression cylinder 20 is mounted for movement toward and away from the plate cylinder 18 such that the web 12 may selectively engage and disengage from the plate cylinder 18. By displacing the impression cylinder into engagement with plate cylinder 18, the image on the plate cylinder 18 may be transferred to the web 12 extending about the impression cylinder 20. It will be appreciated that each flexographic unit forms the images on the substrate selectively as the substrate passes over the impression cylinder. For example, portions of the web 12 forming the various pages may contain only variable information and, hence, not be printed at all by the flexographic printer 14. On other occasions, the first flexographic printer 14 will print on certain portions of the substrate 12, while the follow-on flexographic printer(s) 14 will print non-variable information on other portions of the substrate.

As illustrated in FIG. 2, the inker roll 14 is mounted for rotational movement about its center axis A and for pivoting movement about an axis B toward and away from the plate cylinder 18. The inker roll 16 is disposed such that a portion of the roll lies in an ink reservoir, designated R. An actuator schematically illustrated at 26 is coupled to the inker roll 16 at 28. Actuator 26 pivots the inker roll 16 about pivot B into and out of engagement with the plate cylinder 18. The distance of travel of the inker roll 16 is indicated at a. That is, the inker roll 16 is displaced toward and away from the plate cylinder 18 a distance a preferably about 0.010 inch as measured between the nearest opposite surfaces thereof. As explained previously, the actuator 26 actuates the inker roll 16 to engage plate cylinder 18 during a print cycle, for example, a single revolution of the plate cylinder. The actuator 26 may then pivot inker roll 16 about pivot B away from plate cylinder 18, opening the distance between the inker roll and plate cylinder by a distance a.

It will be appreciated that the inker roll 16 is driven by a flexible coupling between the shafts on which the respective roll and cylinder are mounted. Accordingly, the roll 16 and cylinder 18 are rotated about their respective axes at identical speeds. A doctor blade 30 is mounted such that its edge in contact with the inker roll 16 lies along a diameter passing through the pivot B and the axis of rotation A and on the side of the axis of rotation A remote from pivot B. By locating the doctor blade along the diametrical line, the pivotal movement of the inker roll 16 about pivot B is essentially a straight line movement toward the plate cylinder 18 parallel to the tangent of the point of contact of the doctor blade with the inker roll 16. Thus, the doctor blade 30 maintains substantially constant pressure on the inker roll 16.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a printing apparatus for selectively printing non-variable information on discrete document portions of a single web during a discrete continuous printing run for said web including an inker roll, a plate cylinder and an impression cylinder mounted for rotation about parallel axes, a method of operating the printing apparatus, comprising the steps of:

selectively and periodically displacing the inker roll into contact with the plate cylinder during the continuous discrete printing run for said web in response to computer-generated print commands to transfer ink from the inker roll to the plate cylinder upon initiation of printing revolutions of said inker roll, plate cylinder and impression cylinder to print the non-variable information on selected discrete document portions of the web; and selectively and periodically displacing the inker roll away from and out of contact with the plate cylinder during the continuous discrete printing run for said web upon initiation of non-printing revolutions of the inker roll, plate cylinder and the impression cylinder to prevent transfer of ink from the inker roll to the plate cylinder and onto other discrete document portions of said single web.

2. A method according to claim 1 including displacing the inker roll away from the plate cylinder to a distance of about 0.010 inch from the plate cylinder as measured between nearest opposite surfaces thereof.

3. A method according to claim 1 wherein a doctor blade contacts the inker roll and the inker roll is mounted for movement toward and away from the plate cylinder, and including displacing the inker roll toward the plate cylinder in a direction perpendicular to the axis of rotation of the inker roll and along a substantially straight line parallel to a tangent defining the line of contact between the doctor blade and the inker roll.

4. A method according to claim 1 including maintaining the plate cylinder stationary as the inker roll is displaced into and out of contact with the plate cylinder.

5. A method according to claim 1 including displacing the impression cylinder into and out of contact with the plate cylinder upon initiation of printing and non-printing revolutions of the inker roll, plate cylinder and impression cylinder.

6. A method according to claim 5 including maintaining the plate cylinder stationary as the inker roll and impression cylinder are displaced into and out of contact with the plate cylinder.

7. A method according to claim 6 wherein a doctor blade contacts the inker roll and the inker roll is mounted for movement toward and away from the plate cylinder, and including the step of displacing the inker roll toward the plate cylinder in a direction perpendicular to the axis of rotation of the inker roll and along a substantially straight line parallel to a tangent defining the line of contact between the doctor blade and the inker roll.

8. In a printing apparatus for selective printing non-variable information on discrete document portions of a single web during a discrete continuous printing run for said web including an inker roll, a plate cylinder and an impression cylinder carrying the web, the inker roll and cylinders being mounted for rotation about parallel axes, a method of operating the printing apparatus, comprising the steps of:

selectively and periodically displacing the impression cylinder and web carried thereby into contact with the plate cylinder during the continuous discrete printing run for said web in response to computer-generated print commands to transfer ink from the plate cylinder to the web during printing revolutions of said inker roll, plate cylinder and impression cylinder to print the non-variable information on selected discrete document portions of the web; and selectively and periodically displacing the impression cylinder and the web carried by the impression cylinder during the discrete printing run away from and out of contact with the plate cylinder during non-printing revolutions of the inker roll, plate cylinder and the impression cylinder to prevent transfer of ink from the plate cylinder to the web and onto other discrete portions of said single web.

9. A method according to claim 8 including maintaining the plate cylinder stationary as the impression cylinder and the web carried thereby is displaced away from the plate cylinder.

* * * * *

UNITED STATES PATENT AND TRADEMARK OFFICE

CERTIFICATE OF CORRECTION

PATENT NO. : 6,035,782
DATED : March 14, 2000
INVENTOR(S) : Jimmie A. Harrod, et al.

It is certified that error appears in the above-indentified patent and that said Letters Patent is hereby corrected as shown below:

On the title page, item [63] filing date should read –May 1, 1998--.

The title page should be deleted to appear as per attached sheet.

The sheet of drawing, consisting of figure 2 should be deleted to appear as per attached sheet.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*

United States Patent [19]

Harrod et al.

[11] Patent Number: 6,035,782

[45] Date of Patent: Mar. 14, 2000

[54] SELECTIVE FLEXOGRAPHIC PRINTING WITH MOVABLE ANILOX ROLL

[75] Inventors: Jimmie A. Harrod, Grand Island; Henk Haan, Niagara Falls, both of N.Y.

[73] Assignee: Moore U.S.A. Inc., Grand Island, N.Y.

[21] Appl. No.: 09/272,619

[22] Filed: Mar. 19, 1999

Related U.S. Application Data

[63] Continuation of application No. 09/070,774, May 1, 1999.

[51] Int. Cl.[7] ..... B41C 33/00

[52] U.S. Cl. ..... 101/483; 101/484; 101/485; 101/350.1

[58] Field of Search ..... 101/483, 350.1, 101/350.2, 350.3, 350.4, 351.2, 351.3, 245, 247, 218, 484, 485, 486, 351.1

[56] References Cited

U.S. PATENT DOCUMENTS

| | | | |
|---|---|---|---|
| 2,737,109 | 3/1956 | Hertsch | 101/245 |
| 3,143,693 | 8/1964 | Schrempp | 101/351.3 |
| 3,163,110 | 12/1964 | Thompson | 101/351.3 X |
| 3,760,723 | 9/1973 | Taig | 101/350 |
| 3,762,323 | 10/1973 | Hartka et al. | 101/350 |
| 3,859,915 | 1/1975 | Hunter | 101/103 |
| 3,903,793 | 9/1975 | Schubert | 101/351.2 |
| 4,309,945 | 1/1982 | Marion | 101/247 |
| 4,964,337 | 10/1990 | Bognar et al. | 101/350 |
| 4,987,831 | 1/1991 | Weder | 101/350 |
| 5,031,532 | 7/1991 | Walther | 101/351 |
| 5,088,407 | 2/1992 | Helm et al. | 101/350 |
| 5,191,836 | 3/1993 | Weis | 101/247 X |
| 5,228,390 | 7/1993 | Jahn | 101/352 |
| 5,791,246 | 8/1998 | Kelm | 101/218 |
| 5,806,427 | 9/1998 | Niemiro et al. | 101/247 |

*Primary Examiner*—Ren Yan
*Assistant Examiner*—Minh H. Chau
*Attorney, Agent, or Firm*—Nixon & Vanderhye P.C.

[57] ABSTRACT

A printing apparatus includes an inker roll, a plate cylinder and an impression cylinder mounted for rotation about parallel axes. The inker roll is selectively displaced into engagement and disengagement with the plate cylinder to transfer ink to the plate cylinder and to a substrate about the impression cylinder. The inker roll is moved to transfer ink only during printing cycles and is out of engagement with the plate cylinder during non-printing cycles. A doctor blade engages the inker roll along a diameter thereof passing through the pivotal axis of the inker roll and its axis of rotation and on the side of the axis of rotation remote from its pivotal axis.

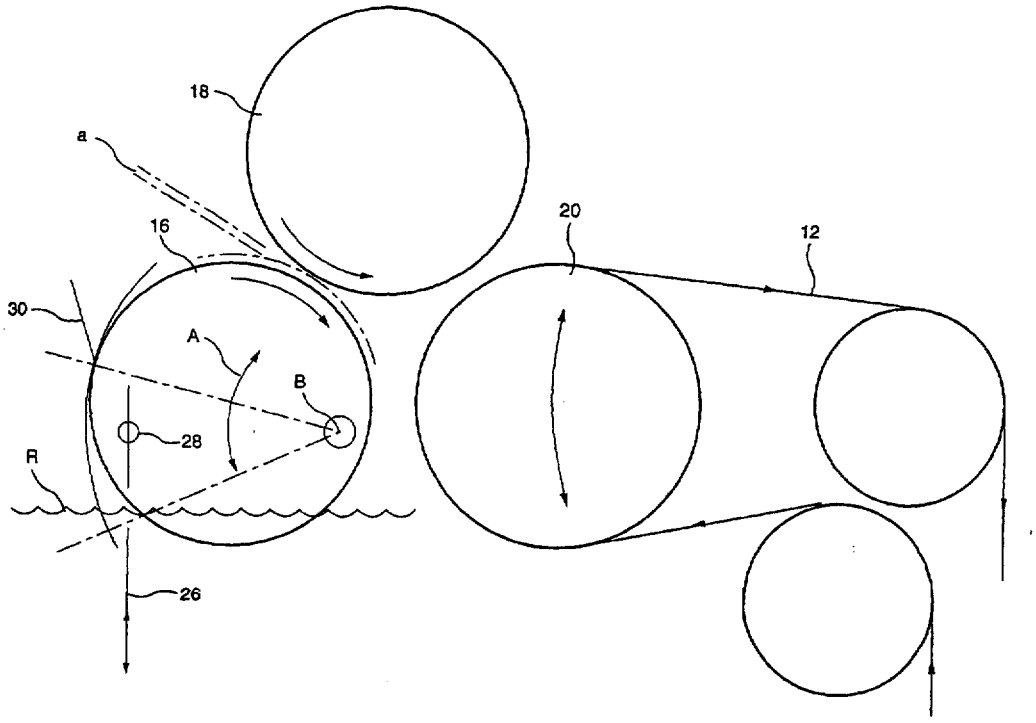

9 Claims, 2 Drawing Sheets